United States Patent [19]

Hanson

[11] Patent Number: 4,744,440

[45] Date of Patent: May 17, 1988

[54] EXHAUST GAS SILENCING DEVICE

[75] Inventor: Roger D. Hanson, Jackson, Mich.

[73] Assignee: Tenneco, Inc., Tenneco Automotive Bldg., Lincolnshire, Ill.

[21] Appl. No.: 60,317

[22] Filed: Jun. 10, 1987

[51] Int. Cl.[4] ..... F01N 7/08

[52] U.S. Cl. ..... 181/227; 181/228; 181/250

[58] Field of Search ..... 181/227, 228, 248–251

[56] References Cited

U.S. PATENT DOCUMENTS

| | | | |
|---|---|---|---|
| 3,196,976 | 7/1965 | Powers et al. | 181/248 |
| 3,338,331 | 8/1967 | Jettinghoff | 181/227 |
| 3,382,948 | 5/1968 | Walker et al. | 181/250 |

*Primary Examiner*—B. R. Fuller

[57] ABSTRACT

An exhaust silencing device comprises an outer tube that is pinched down to form a series of annular chambers around a coaxial inner gas flow tube and has openings connecting the chambers to provide for some secondary gas flow parallel to primary flow through the tube. The device and is shown in conjunction with a catalytic converter to provide an exhaust system that has a sporty sound.

8 Claims, 3 Drawing Sheets

EXHAUST GAS SILENCING DEVICE

BACKGROUND OF THE INVENTION

This invention relates to exhaust gas silencing devices for use in the exhaust systems of motor vehicles having combustion engines. It concerns an acoustic component in which an outer metal shell is deformed into contact with a perforated gas flow tube to form a series of longitudinally separated chambers surrounding the tube and is a modification of the components described in U.S. Pat. Nos. 3,196,976 (issued July 27, 1965), 3,338,331 (issued Aug. 29, 1967), and 3,382,948 (issued May 14, 1968).

BRIEF SUMMARY OF THE INVENTION

It is the purpose of this invention to provide an exhaust gas silencing device of simple construction that has primary and secondary flow paths for gas and which is particularly well suited for use in automotive exhaust systems containing a catalytic converter. The invention accomplishes this purpose by means of a construction comprising an inner gas flow tube that provides a primary flow path. The tube is perforated or louvered along its length and is surrounded by an outer tube which is radially pinched down into joints with the inner tube by means of U-shaped bights or folds, at longitudinally separated intervals, to form collars that are in contact with the tube thereby forming a series of annular chambers around the tube which are in communication with it through the louvers in the tube. In accordance wtih a basic form of the invention a secondary gas flow path is provided by separating the sides of the bights or folds so that gas can flow readily from one annular chamber to the next along the length of the outer tube and in accordance with another form of the invention a path for secondary gas flow just described is amplified by spacing one or more of the collars radially outwardly from the tube so that gas can flow from one chamber to another through the annular space between the collar and tube as well as through the bights or folds.

Other features of the invention will become apparent hereinafter.

DETAILED DESCRIPTION

Figures 1, 2, 3, 4, 5:
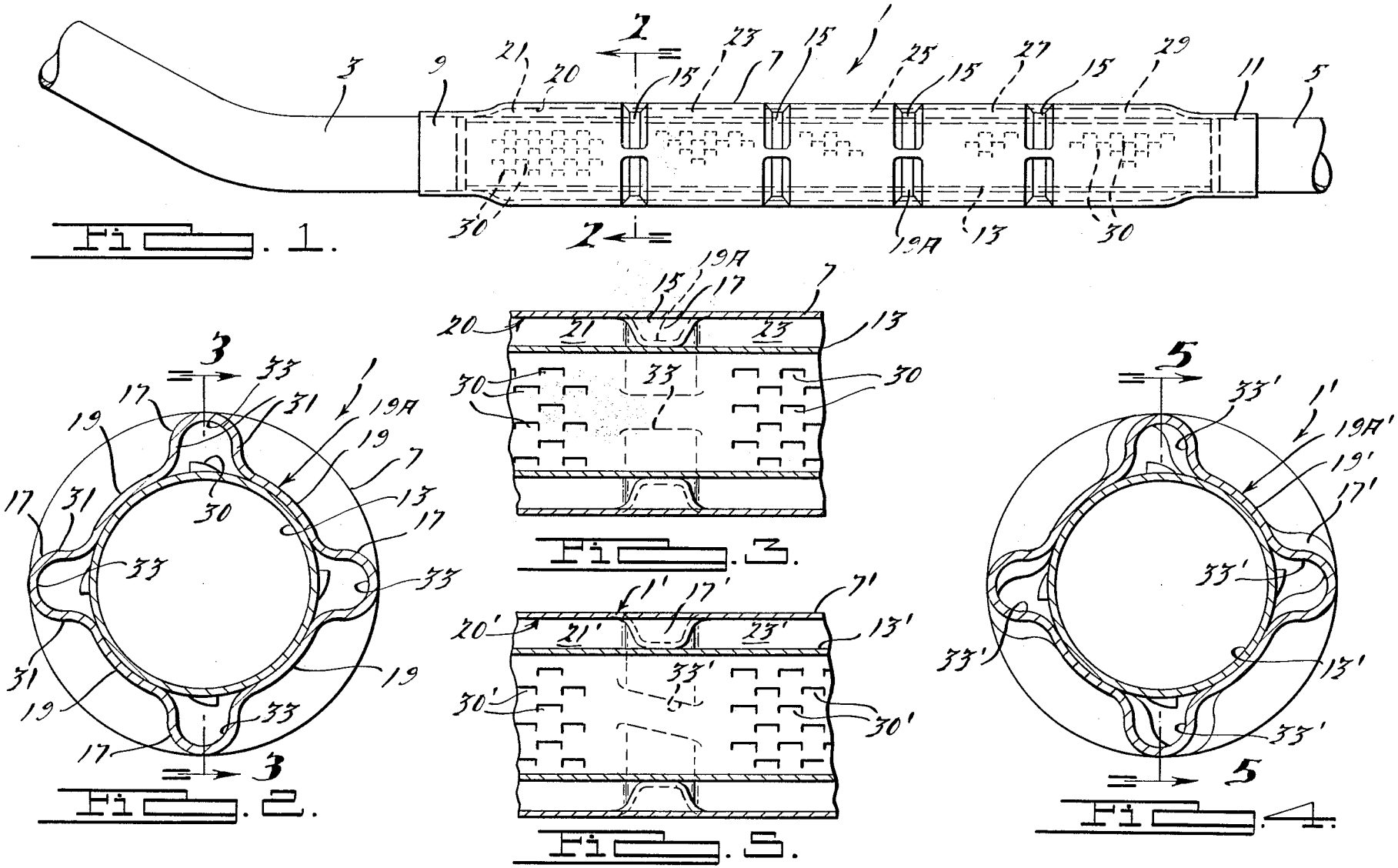
FIG. 1 is a side elevation, broken away, of a silencing device embodying one form of the invention and showing it connected at its inlet end to an exhaust pipe and at its outlet end to a tailpipe.
FIG. 2 is an enlarged cross section along the line 2—2 of FIG. 1.
FIG. 3 is a reduced size cross section, broken away, along the line 3—3 of FIG. 2.
FIG. 4 is a cross section similar to FIG. 2 but showing a modification in which structure corresponding to that in FIGS. 1-3 is identified by the same reference numbers but with a prime (') added.
FIG. 5 is a reduced size cross section, broken away, along the line 5—5 of FIG. 4.

As shown in FIG. 1, a basic form of silencing device 1 according to the invention is connected between an exhaust pipe 3 which conducts exhaust gases to it and a pipe section 5 which conducts gases away from it, e.g., to other components in a motor vehicle exhaust system (not shown) or the section 5 may itself be a tailpipe carrying gas to the rear of a vehicle for discharge to atmosphere. The device 1 comprises a one piece tubular metal outer shell 7 (which is preferably 3" in outer diameter for automotive use) that is swaged or necked down at its inlet end into an integral inlet bushing 9 and at its outlet end into an integral outlet bushing 11. Bushings 9 and 11 receive the ends of pipes 3 and 5, respectively, and means (not shown) such as clamps or welds may be used to tightly connect the pipes to the bushings.

The device also includes a straight-through-flow inner pipe 13 (preferably 2" in outer diameter and 20" or less in length) which opens at its upstream end into the end of pipe 3 and is supported there inside of bushing 9 and which also opens at its downstream end into tailpipe 5 and is supported there inside of bushing 11. The pipe 13 may be spot-welded or otherwise affixed to one or both of the bushings 9 and 11. Gas entering the device 1 can flow straight through pipe 13 which therefore provides a primary path for gas flow.

The outer tube 7 is pinched down at four longitudinal separated locations into contact with the inner pipe 13 at four joints 15. Each joint is formed by pinching the outer tube 7 at four short U-shaped bights 17, spaced 90 degrees apart, the bights being interconnected by four circular or arcuate segments 19 which in effect form a circular collar 19A that tightly grips (and may be spot-welded to) the outside of the pipe 13. The four joints 15 provide reduced diameter radial sections in the outer tube 7 which act along with the swaged ends of the outer shell 7 to subdivide the annular space 20 between the shell and the pipe 13 into five, longitudinally separated annular chambers 21, 23, 25, 27, and 29.

In accordance with the invention, the sides 31 of the bights 17 are spaced apart to leave openings 33 that interconnect the chambers 21, 23, 25, 27 and 29. The inner pipe 13 is perforated along its length so that gas in it can communicate with and/or flow into the space 20. The perforation of pipe 13 is preferably in the form of patches of louvers 30 in each of the chambers 21, 23, 25, 27, and 29. Gas that flows radially outwardly from pipe 13 into space 20 can then flow from one chamber 21, 23, 25, and 27 to the next and from chamber 29 (or the others) radially inwardly back into pipe 13, thereby following a secondary flow path through chamber 20 along the outside of pipe 13. The amount of secondary flow can be adjusted by varying the separation of sides 31, i.e., the size of openings 33, since this will vary the resistance to passage of the gas from one chamber to the next. Such adjustment in the size of openings 33 could be different for different joints 15 so that the pressure in the respective chambers 21, 23, 25, 27, and 29 can be varied in accordance with static pressure variations along the length of inner pipe 13 or to provide some individual control over the attenuation that occurs in the respective chambers. In device 1 each of the bights 17 at each joint is preferably open and open the same amount to promote uniformity of flow and a substantial annular and tubular flow pattern in the secondary flow path. However, the sizes of openings 31 can vary if desired to achieve different effects in the secondary flow path such as an optimum degree of turbulence. Even though there is flow along space 20 the louvers (or perforations) in tube 13 in conjunction with the respective chambers will provide attenuation of high frequency sound and roughness, i.e., the "spit" chamber effect, this being subject to some control or adjustment by means of adjustment of the sizes of openings 33.

The channels 33 in device 1 are parallel to the common axis of tubes 7 and 13 but the device 1' of FIGS. 4 and 5 shows channels 33' at an angle to this axis as formed by squeezing bights 17' on an angle. Channels 33' will produce a spiral pattern in the secondary flow path so that the gas will rotate around the outside of pipe 13' as it flows downstream. This can be in the same direction as rotation produced by louvers 30' or in the opposite direction if turbulence is desired.

As indicated, the sizes of the channels 33 and 33' can be adjusted and varied. Straight (33) and angular (33') channels can be used together, if desired. Selected channels can be closed (i.e., opposite sides 31 are in contact) to block flow. Channels can be at different angles. Thus, control of the size and orientation of channels 33 and 33' provides means to vary the secondary flow path and to vary the conditions in the respective chambers 21, 23, 25, 27, and 29. This can be supplemented by varying the sizes, orientation, shapes, locations, and numbers of louvers 30 (or 30') in the flow tube 13 (or 13'). These various possibilities for adjustment which a construction embodying the invention permits provide substantial design flexibility with respect to flow resistance (i.e., back pressure) and attenuation of undesired sound in the exhaust gas flowing through the device. Nevertheless, structure embodying the invention is very simple.

A variation of structure used to provide secondary flow is illustrated in several modified forms of the invention shown in FIGS. 6–12. Referring first to the silencing device 101 of FIGS. 6–7, it is connected between an exhaust pipe 103 and a tailpipe 105. It has a one piece tubular metal outer shell 107 (which, like tube 7, is preferably 3" in outer diameter). It is necked down at its inlet end into contact with an inlet bushing 109 and at its outlet end into contact with an outlet bushing 111, the tube 107 preferably being rigidly affixed to the bushings by arc welding or spot welding. Bushings 109 and 111 receive the ends of pipes 103 and 105, respectively.

The device 101 has a straight-through-flow primary path for gas passage through it and this is provided by a pair of substantially identical, but end-for-end reversed, inner metal pipes **113*a* and 113*b* (preferably 2" in outer diameter). Pipe 113*a* is located at the upstream or inlet end of device 101 and is supported in the necked down inlet end of the tubular shell 107 while pipe 113*b* is located at the downstream or outlet ends of device 101 and supported in the necked down outlet end of the shell 107. The open downstream end of pipe 113*a* and the open upstream end of pipe 113*b* are spaced apart by a gap 114 of preferably about 3" if the length of the shell 107 exceeds 20". The shell 107 of device 101** is preferably 24" long.

The tubular outer shell 107 is reduced in diameter at several radial sections by means of pinches at four longitudinally separated locations which form four joints 115 and 115', three of the joints 115 are shown to be in contact with the inner pipes while the fourth joint 115' is not in contact. Each joint is formed by pinching the outer tube 107 at four short U-shaped bights 117 or 117', spaced 90 degrees apart, the bights being interconnected by four circular or arcuate segments 119' (FIG. 7) or 119 (FIG. 8) which in effect form circular collars 119A' or 119A. The segments 119 tightly grip and may be spotwelded to the outsides of pipes **113*a* and 113*b*. However, the segments 119' and collar 119A' are radially spaced from the outsides of pipes 113*a* and 113*b*, the collar 119A' preferably being about 2.5" O.D. for an inner pipe O.D. of 2.0" and about 0.4" to 0.5" long. The four joints 115 and 115' along with the necked down ends of the shell 107 subdivide the space in the shell outside of pipes 113*a* and 113*b* into five longitudinally separated chambers, 121, 123, 125, 127, and 129**.

In accordance with the invention, the sides 131' of the bights 117' are spaced apart to leave openings or flow channels 133 that interconnect the chambers 121 and 123 for secondary flow. This is amplified by the annular space or channel 134 between collar 119A' and pipe **113*a*. The sides 131 of the bights 117 are preferably in contact so that joints 115 serve to separate chambers 125, 127, and 129 from each other. The inner pipes 113*a* and 113*b* are perforated along the portions of their lengths that are within the chambers 121 and 123 (for pipe 113*a*) and chambers 127 and 129 (for pipe 113*b*) so that gas in these pipes is in communication with the chambers. The perforations in the pipes are preferably in the form of louver patches 135** extending circumferentially all around the pipes.

Gas flowing into the device 101 can follow a primary flow path along pipe **113*a*, across gap 114, into and along pipe 113*b* and out of the device into tailpipe 105. A secondary flow path parallel to the primary path is provided from chamber 121 to chamber 123 through channels 133 and 134. All chambers will function to provide attenuation of high frequency sound and roughness in gas flowing through the device. Gas flowing across gap 114 in chamber 125 can expand substantially whereby this chamber will also function to attenuate medium frequencies and to provide some low frequency attenuation. Secondary flow between chambers 121 and 123 also functions to improve the flow pattern, attentuate medium frequencies, and provide some reduction in the back pressure characteristics of the device 101**.

Figure 6:
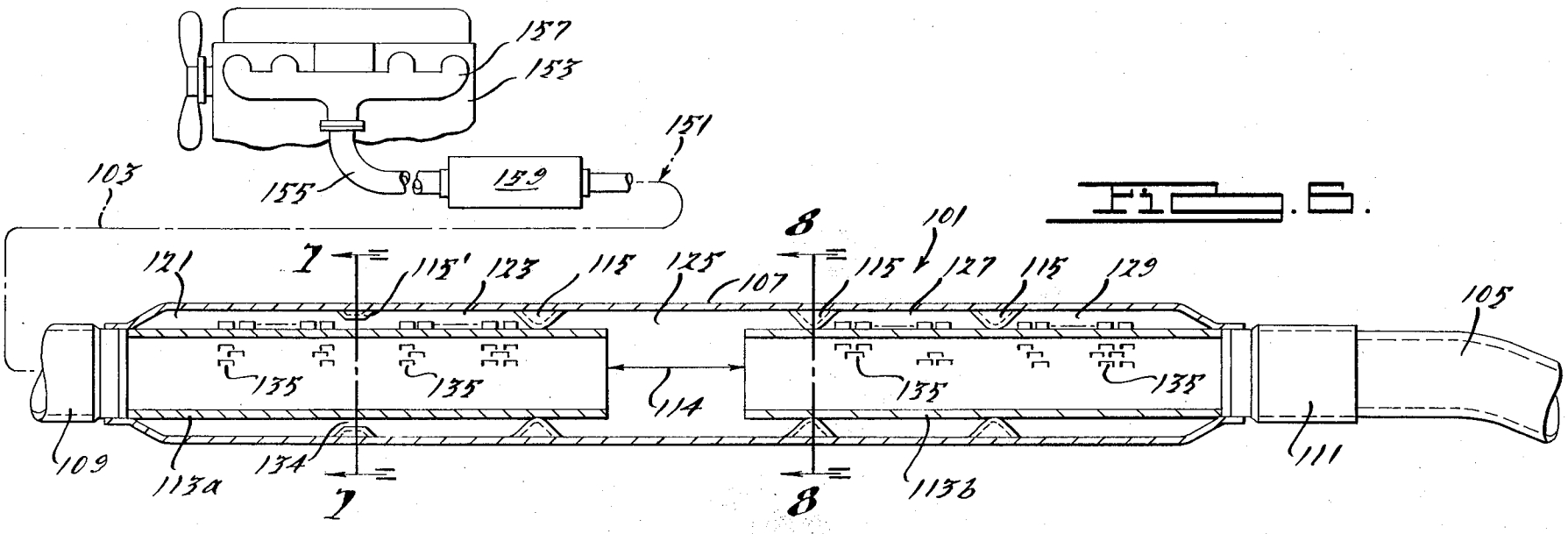
FIG. 6 is a schematic side elevation of an exhaust system for an internal combustion engine that has a catalytic converter in it adjacent the engine and a silencing device (shown enlarged and in longitudinal cross section) embodying another form of the invention located downstream from the engine adjacent the end of the exhaust system, this system being intended to provide a "sporty" sound by attenuating high and medium frequencies but allowing some low ("sporty") frequencies to pass through the system, the overall length of the device with bushings being about 30" and without bushings about 24"
Figure 7:
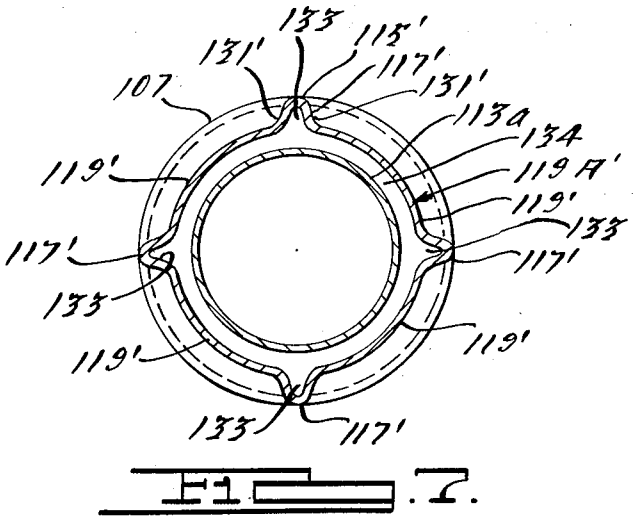
Figure 8:
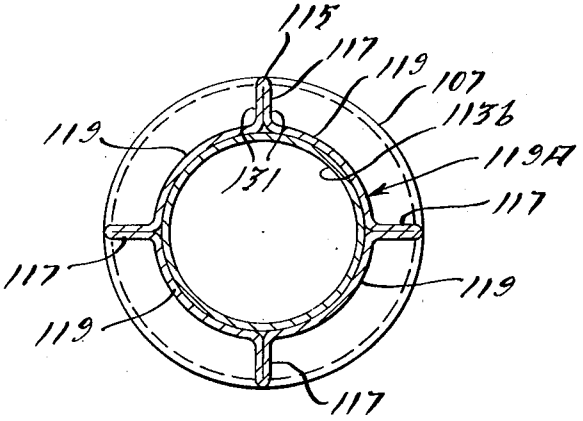
FIG. 8 is a cross section along line 8-8 of FIG. 6.

FIG. 6 also shows the device 101 as a part of an exhaust gas system 151 for a motor vehicle internal combustion engine 153. The system includes an exhaust pipe 155 receiving gas from the exhaust manifold 157 of the engine and delivering it to a catalytic converter 159 of a suitable type available on the open market. Treated gas discharged by the converter 159 flows through pipe 103 to device 101 as previously mentioned.

As is well known, the most popular converters contain catalyst coated pellets or catalyst coated passages in a honeycomb monolith. Either design, in addition to assisting in the conversion of undesirable constituents in the exhaust gases to more acceptable form, functions to attenuate a broad range of sound frequencies in the exhaust gases. In order to secure optimum performance from the converter 159 in the conversion process it is placed as close as possible to the exhaust manifold so that the gases are as hot as possible. By placing the device 101 in the system 151, high frequencies are attenuated along with some medium frequencies as mentioned above. The device 101 is designed to allow unobjectionable lower frequencies to remain so that the system produces a sporty, power sound associated with substantial elimination of high and medium sound frequencies and pass-through of some of the lower frequencies.

Figures 9, 10, 11, 12:
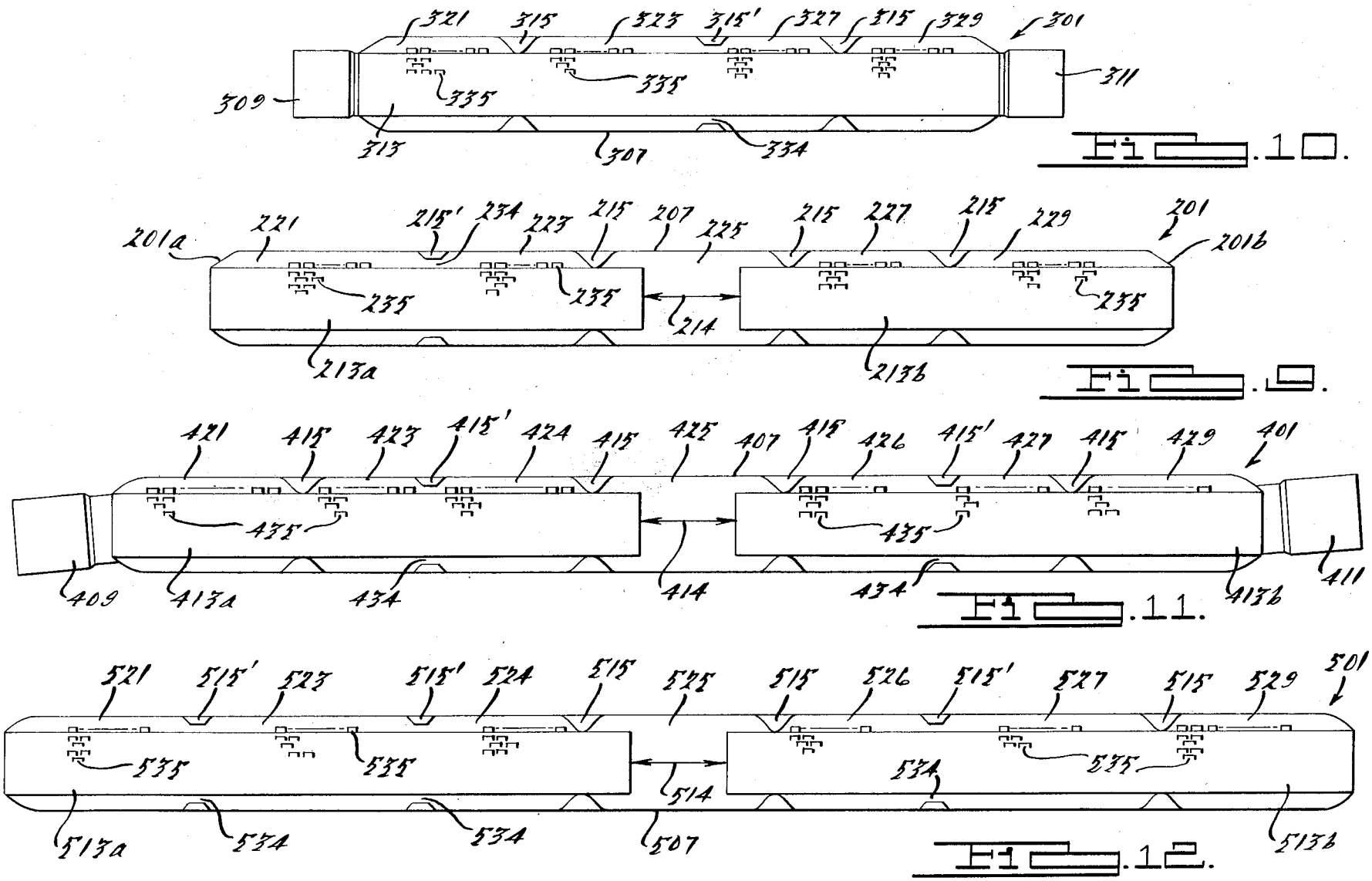
FIG. 9 is a cross section through a silencing device similar to the one of FIG. 6 but without bushings at the ends and having a somewhat longer overall length of about 30" obtained by lengthening the spit chambers, the illustration being somewhat schematic in this Figure and in FIGS. 10-12 because metal thickness is represented simply by a single line.
FIG. 10 is a schematic longitudinal cross section through another form of silencing device embodying the invention, this unit being about 24" in overall length and without bushings about 20" long.
FIG. 11 is a schematic longitudinal cross section through another form of silencing device embodying the invention, this unit being about 42" in overall length with offset bushings and without bushings being about 36" long.
FIG. 12 is a schematic longitudinal section through another form of silencing device embodying the invention similar to the one of FIG. 11 but being substantially longer since certain of the spit chambers are longer, this unit without bushings being about 42" long.

The compact, pipe-like design of devices 1 and 101 (and the modifications hereinafter described) are very suitable for after-market sale and installation—by muffler shops, for example. The installer can simply select the length he needs, the end structure he prefers, and then clamp or weld the device in place. FIG. 9, for example, shows a device 201 that except for the ends 201*a* and 201*b* is essentially the same as the device 101. The muffler mechanic in the field can insert the device 201 into an exhaust system by welding conduits to ends 201*a* and 201*b* so that gas is delivered to upstream pipe 213*a* and received from downstream pipe 213*b*. The device 101 (with bushings) in a practical embodiment will be about 30" long. Device 201, without bushings, and of the same internal design as device 101 is also 30" long, the length increase being due to the increases in the lengths of the spit chambers 221, 223, 227, and 229, chamber 125 (and 225) being the same length in both devices. Enlarging the spit chambers with a corresponding increase in length of the louver patches 235, provides a somewhat enhanced capacity to attenuate high and medium sound frequencies. Certain features of device 201 that correspond to those of device 101 have reference numbers corresponding to those of FIGS. 6–8 but with one hundred added.

A shorter device 301 is shown schematically in FIG. 10. Certain features of device 301 that correspond to those of device 101 have reference numbers corresponding to those in FIGS. 6–8 but with two hundred added. This device has an inner tube 313 that is 20" long so the gap 114 is not needed. The tubular outer shell 307 is pinched down at three locations 315 and 315' to form spit chambers 321, 323, 327, and 329. Pinch 315' corresponds to FIG. 7 and is shallow so that secondary flow from chamber 323 to 327 is provided as previously described in connection with muffler 101. Device 301 is shown with end bushings 309 and 311 bringing its overall length to 24" in a practical embodiment.

A longer device 401 is shown schematically in FIG. 11. Certain features of device 401 that correspond to those of device 101 have reference numbers corresponding to those of FIGS. 6–8 but with three hundred added. The shell 407 is pinched down at six locations 415 and 415' to form seven chambers, 421, 423, 424 (added to device 101) 425, 426 (added to device 101), 427, and 429. Two pinches 415' correspond to FIG. 7 and are shallow to provide secondary flow between chambers 423 and 424 and between chambers 426 and 427. Device 401 is shown with offset end bushings 409 and 411 so that in a practical embodiment its overall length might be about 42". Without the bushings (i.e. like device 201), the length of device 401 would be about 36".

A still longer device 501 is shown schematically in FIG. 12. Certain features of device 501 that correspond to those of device 101 have reference numbers corresponding to those of FIGS. 6–8 but with four hundred added. Device 501 is about six inches longer than device 401 when both are without bushings, and this increase is obtained by adding three inches to each of spit chambers 423 and 427 (chambers 523 and 527, respectively, in FIG. 12). The shell 507 is pinched down at six locations 515 and 515' to form seven chambers 521, 523, 524, 525, 526, 527, and 529 (corresponding, respectively, to chambers 421, 423, 424, 425, 426, 427, and 429). Three pinches 515' correspond to FIG. 7 to provide secondary flow through three chambers 521, 523, and 524, and between chambers 526 and 527. Chambers 521 and 523 could be separated from each other (as are their counterparts 421 and 423) but the arrangement shown in FIG. 12 illustrates how the length of secondary flow can be easily adjusted to provide fine variations in acoustic performance and/or in back pressure.

The exhaust gas silencing devices described above have minimum flow restriction and therefore very low back pressure. They are therefore especially useful in vehicles having catalytic converters where optimum performance is desired. The designed lengths (as illustrated by the various lengths) can be such that they can be used to replace the stock (O.E.) muffler and/or stock intermediate pipe on the outlet side of the converter for various light trucks or other vehicles. The small diameter of the devices give maximum ground clearance thus making them particularly desirable for current model light trucks, recreational towing, or off-roading where best performance is desired. The different chambers in the devices control different ranges of noise frequencies but allow a throaty sound of power to remain. This along with high performance and high ground clearance qualify them superbly for those who value performance in light trucks or other automotive vehicles.

Modifications in the specific details shown and described can be made without departing from the spirit and scope of the invention.

What is claimed is:

1. A silencing device for automotive exhaust gas systems or the like comprising an inner gas flow tube and an elongated outer tube around the inner tube and substantially coextensive in length with it and providing an annular space between the tubes, said inner tube defining a primary gas flow path and being perforated along its length whereby gas flowing along the inside of the inner tube is in communication with said annular space, said outer tube having a plurality of radial sections reduced in diameter to subdivide said annular space into a longitudinal series of annular chambers around the inner tube, each said radial section comprising U-shaped fold portions and a plurality of arcuate portions concentric with the inner tube, certain of said radial sections having spaced apart fold portions to provide gas flow channels interconnecting adjacent annular chambers whereby a secondary gas flow path is provided for gas to flow from one annular chamber to the next on the outside of said inner tube and parallel to the primary flow path.

2. A silencing device as set forth in claim 1 wherein said inner and outer tubes are coaxial and said folds and gas flow channels are on angles to the axis of said tubes.

3. A silencing device as set forth in claim 1 wherein said inner and outer tubes are coaxial and said folds and gas flow channels are parallel to the axis of the tubes.

4. A silencing device as set forth in claim 1 wherein certain of said arcuate portions engage the outside of the inner tube and certain other of said arcuate portions are radially spaced from said inner tube to provide additional gas flow channels interconnecting adjacent annular chambers and additional secondary gas flow.

5. A silencing device as set forth in claim 1 wherein said inner tube is of one piece continuous construction of about 2" diameter and said outer tube is of about 3" diameter and no longer than about 20".

6. A silencing device as set forth in claim 1 wherein said inner tube is of two-piece construction comprising an upstream section and a downstream section, the outlet end of the upstream section and the inlet end of the downstream section being located in one of said annular chambers and separated from each other by a gap whereby gas must flow in said one annular chamber across said gap in passing from said outlet end of the upstream section to the inlet end of the downstream section.

7. A silencing device as set forth in claim 6 wherein said inner tube is about 2" in diameter and said outer tube is about 3" diameter and no less than about 20" in length and said gap is about 3" in length.

8. In an exhaust gas treatment and silencing system for the internal combustion engine of a motor vehicle, said system having an inlet receiving exhaust gas from the engine and an outlet end for discharging as to atmosphere, said system including a catalytic converter located near the inlet end and a silencing device located nearer the outlet end, said device serving to attenuate high and medium sound frequencies while passing low sound frequencies whereby said device enables the system to have a sporty sound, said device comprising an inner gas flow tube of about 2" diameter and an elongated outer tube of about 3" diameter around the inner tube and substantially coextensive in length with it and providing an annular space between the tubes, said inner tube providing a primary path for gas flow and being perforated along its length whereby exhaust gas flowing along the inside of the inner tube is in communication with said annular space, said outer tube having a plurality of radial sections reduced in diameter to subdivide said annular space into a series of annular high frequency attenuating chambers around the inner tube, and means in said radial sections providing for a secondary path of gas flow in said annular space.

* * * * *